US007343967B1

(12) United States Patent
Floyd

(10) Patent No.: US 7,343,967 B1
(45) Date of Patent: Mar. 18, 2008

(54) WELL FLUID HOMOGENIZATION DEVICE

(75) Inventor: Raymond E. Floyd, Oklahoma City, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 248 days.

(21) Appl. No.: 11/217,924

(22) Filed: Aug. 31, 2005

Related U.S. Application Data

(60) Provisional application No. 60/686,896, filed on Jun. 3, 2005.

(51) Int. Cl.
*E21B 43/00* (2006.01)

(52) U.S. Cl. ..... 166/68.5; 166/105.5; 417/430

(58) Field of Classification Search ..... 166/105.1, 166/105.5, 177.7, 170, 68.5; 417/430
See application file for complete search history.

(56) References Cited

U.S. PATENT DOCUMENTS 2,071,393 A * 2/1937 Doherty ..... 96/196
4,330,306 A * 5/1982 Salant ..... 96/219
4,830,584 A * 5/1989 Mohn ..... 417/356
6,155,345 A * 12/2000 Lee et al. ..... 166/105.5

* cited by examiner

*Primary Examiner*—Kenneth Thompson
(74) *Attorney, Agent, or Firm*—Crowe & Dunley, P.C.

(57) ABSTRACT

A well fluid homogenization device for use in a pumping system configured to recover fluids from a well includes a central hub and a plurality of posts extending from the central hub. The well fluid homogenization device is configured to rotate with a drive shaft to homogenize well fluid as the well fluid passes through a pumping system. The well fluid homogenization device is well-suited to be incorporated within gas separators and pump assemblies.

6 Claims, 5 Drawing Sheets

WELL FLUID HOMOGENIZATION DEVICE

RELATED APPLICATIONS

This application claims the benefit of U.S. Provisional Patent Application No. 60/686,896, filed Jun. 3, 2005, entitled Well Fluid Homogenizer, the disclosure of which is claimed herein.

FIELD OF THE INVENTION

This invention relates generally to the field of downhole pumping systems, and more particularly to equipment used to condition well fluid during the pumping process.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the wellbore fluids from the subterranean reservoir to a storage facility on the surface.

Wellbore fluids often contain liquids, gases and entrained solid particles. Because most downhole pumping equipment is designed to primarily recover liquid-phase fluids, excess amounts of gas or solids in the wellbore fluid can present problems for downhole equipment. For example, the centrifugal forces exerted by downhole turbomachinery tend to separate gas from liquid, thereby increasing the chances of cavitation or vapor lock. Large slugs or pockets of gas passing through the pumping equipment exacerbate this problem.

Solid particles entrained within the wellbore fluids create similar problems. Solid particles may emanate from a number of sources, including rust, scale and geologic matter. Larger solid particles moving through the pumping system may create blockages or abrade sensitive seals or bearings, or otherwise impair the performance of downhole machinery. To reduce the presence of solid particles in the pumping system, prior art pump assemblies have been fitted with screens or filters. While generally effective at limiting the amount of solid matter passing through the pump assembly, the screens or filters quickly become clogged, thereby adversely affecting the performance of the pump assembly.

Despite these advances in technology, there is therefore a need for an improved downhole pumping system that is more resistant to the inefficiency and damage caused by solid particles and gas entrained in the wellbore fluid. It is to these and other deficiencies in the prior art that the present invention is directed.

SUMMARY OF THE INVENTION

In a preferred embodiment, the present invention includes a well fluid homogenization device for use in a pumping system configured to recover fluids from a well. In a preferred embodiment, the well fluid homogenization device includes a central hub and a plurality of posts extending from the central hub. The well fluid homogenization device is well-suited to be incorporated within gas separators and pump assemblies.

DETAILED DESCRIPTION OF THE PREFERRED EMBODIMENT

Figure 1:
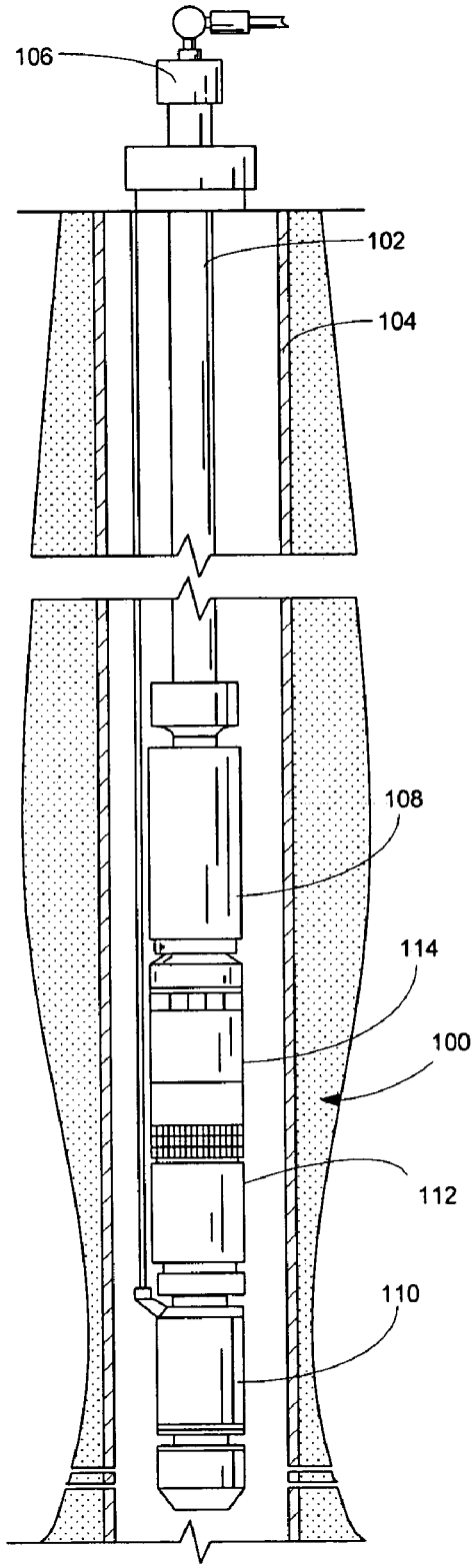
FIG. 1 is elevational view of a downhole pumping system constructed in accordance with a preferred embodiment.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The pumping system 100 preferably includes some combination of a pump assembly 108, a motor assembly 110, a seal section 112 and a gas separator 114. The seal section 112 shields the motor assembly 110 from mechanical thrust produced by the pump assembly 108 and provides for the expansion of motor lubricants during operation. The gas separator 114 is preferably connected between the seal section 112 and the pump assembly 108. During use, wellbore fluids are drawn into the gas separator 114 where some fraction of the gas component is separated and returned to the wellbore 104. The de-gassed wellbore fluid is then passed from the gas separator 114 to the pump assembly 108 for delivery to the surface through the production tubing 102. Although only one of each component is shown, it will be understood that more can be connected when appropriate. For example, in many applications, it is desirable to use tandem-motor combinations, multiple gas separators, multiple seal sections and multiple pump assemblies.

Figure 2:
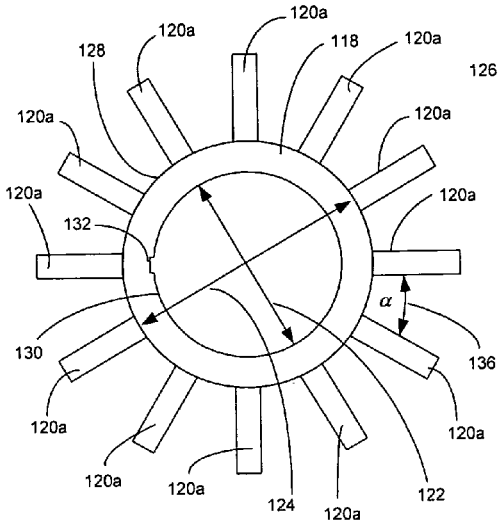
FIG. 2 is a top plan view of a first preferred embodiment of a bushing homogenization device.
Figure 3:
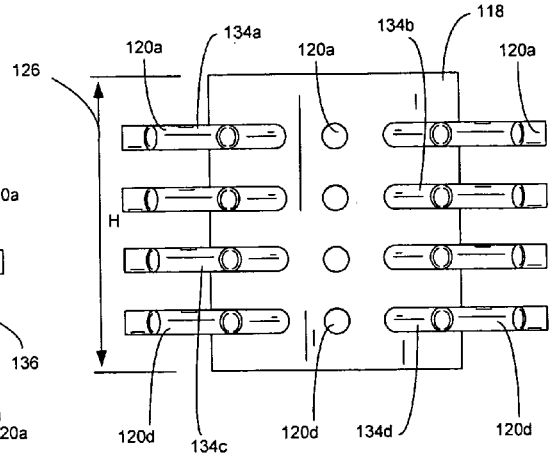
FIG. 3 is a side elevational view of the first preferred embodiment of the bushing homogenization device of FIG. 2.
Figure 4:
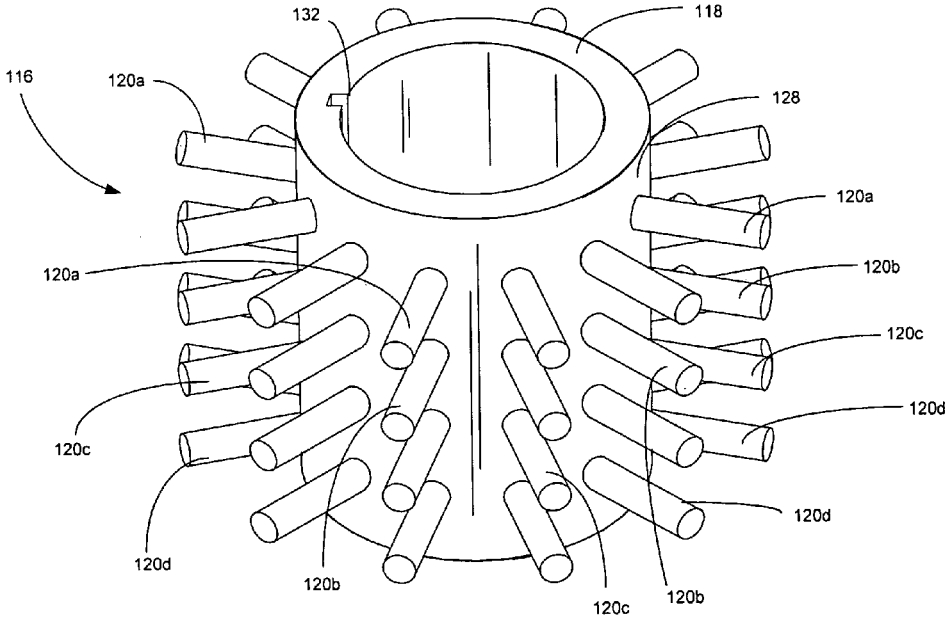
FIG. 4 is a front perspective view of the first preferred embodiment of the bushing homogenization device of FIGS. 2 and 3.

Turning now to FIGS. 2, 3 and 4, shown therein are top, side elevational and front perspective views, respectively, of a first preferred embodiment of a well fluid homogenization device 116. The well fluid homogenization device 116 includes a central hub 118 and a plurality of posts 120. In the presently preferred embodiment, the central hub 118 is configured as a hollow cylinder having an inner diameter (ID) 122, an outer diameter (OD) 124 and a height (H) 126. The central hub 118 has an outer surface 128 at the outer diameter 124 and an inner surface 130 at the inner diameter 126. The central hub 118 is preferably configured to fit over a drive shaft (not shown in FIGS. 2-4).

In the presently preferred embodiments, the central hub 118 also includes a notch 132 that extends longitudinally along the height 126. The notch 132 is configured for mating engagement with a corresponding "key" on the drive shaft. In this way, the central hub 118 rotates with the rotatable drive shaft. Other methods for rigidly securing the central hub 118 to the drive shaft exist and are contemplated as within the scope of the present invention. For example, it may be desirable to press-fit the central hub 118 onto the rotatable drive shaft rather than using a notch-and-key arrangement.

As best shown in FIG. 3, the plurality of posts 120 are configured about the outer surface 128 in a series of rings 134*a*, 134*b*, 134*c* and 134*d* (collectively or generically referred to as "rings 134"). Each ring 134 includes a plurality of posts 120 that extend from the central hub 118 at a common height. When necessary to distinguish between posts 120, each post 120 within a given ring 134 may be designated according to the alphabetic convention used to describe the plurality of rings 134 (i.e., posts 120*a* are included within ring 134*a*). As shown in FIG. 2, the plurality of posts 120*a* are preferably separated from one another within the ring 134*a* by a separation angle (α) 136. In the first preferred embodiment shown in FIGS. 2-4, there are twelve posts 120 in each ring 134 with a common separation angle (α) 136 of approximately 30°. In the first preferred embodiment, the rings 134 are preferably aligned about the circumference of the central hub 118.

The posts 120 are preferably configured as solid, cylindrical members that are constructed from a deformation-resistant, hardened metal, such as steel. The posts 120 of the first preferred embodiment preferably have a common length and circumference. In an alternate preferred embodiment, the posts 120 have rectangular or diamond-shaped cross-sections and are configured with leading and trailing edges to minimize fluid resistance as the posts 120 move through the well fluid. The posts 120 preferably extend perpendicularly from the outer surface 128, as shown in FIG. 2. Although the posts 120 of the preferred embodiment are all commonly sized, shaped and configured about the central hub 118, it will be appreciated that the use of posts 120 of different sizes, shapes or configurations is within the scope of the present invention. For example, it may be desirable to use larger posts 120 with a circular cross-section in combination with smaller posts 120 with a diamond-shaped cross-section.

Figure 5:
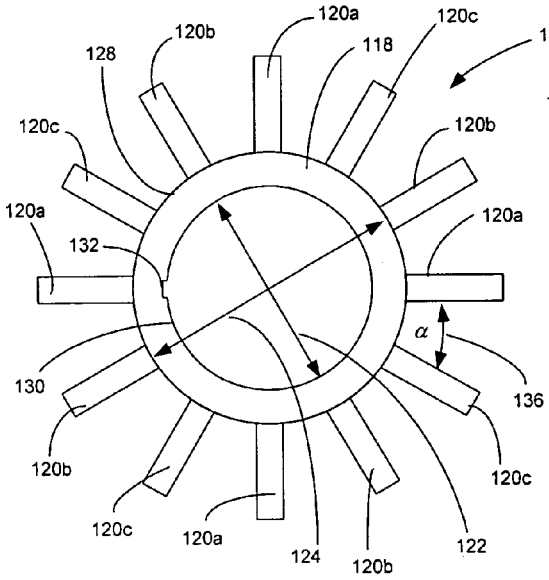
FIG. 5 is a top plan view of a second preferred embodiment of a bushing homogenization device.
Figure 6:
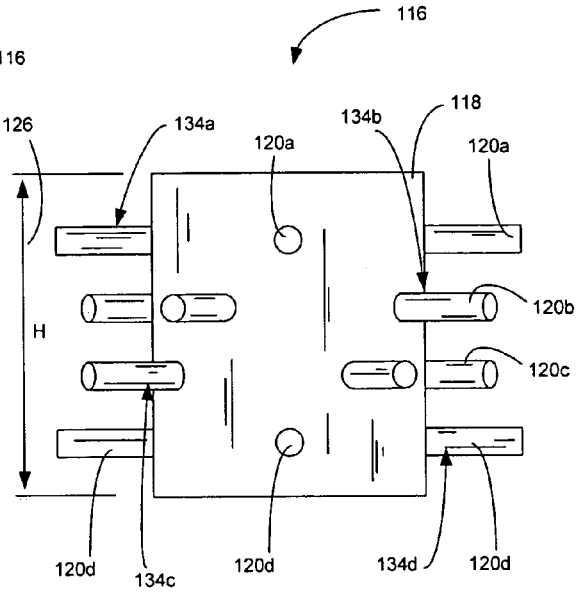
FIG. 6 is a side elevational view of the second preferred embodiment of the bushing homogenization device of FIG. 5.
Figure 7:
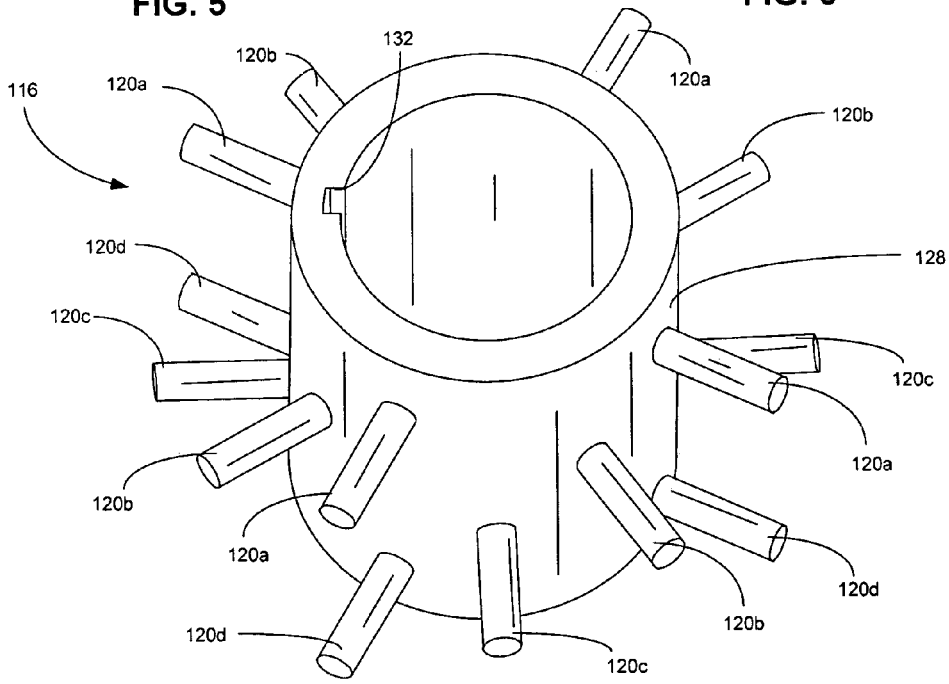
FIG. 7 is a front perspective view of the second preferred embodiment of the bushing homogenization device of FIGS. 5 and 6.

Tuning now to FIGS. 5-7, shown therein are top, side and front perspective views, respectively, of a second preferred embodiment of the well fluid homogenization device 116. In the second preferred embodiment, the well fluid homogenization device 116 includes the same components present in the first preferred embodiment. The well fluid homogenization device 116 of the second preferred embodiment includes a plurality of posts 120 organized within rings 134*a*, 134*b*, 134*c* and 134*d* (collectively or generically referred to as "rings 134") about a central hub 118.

The posts 120 are preferably configured as solid, cylindrical members that are constructed from a deformation-resistance, hardened metal. The posts 120 of the second preferred embodiment preferably have a common length and circumference. Unlike the first preferred embodiment, however, the rings 134 in the second preferred embodiment each include four posts 120 that are separated by a common separation angle (α) 136 of approximately 90°. Additionally, adjacent rings 134 are radially offset by approximately 30° around the circumference of the central hub 118.

Figure 8:
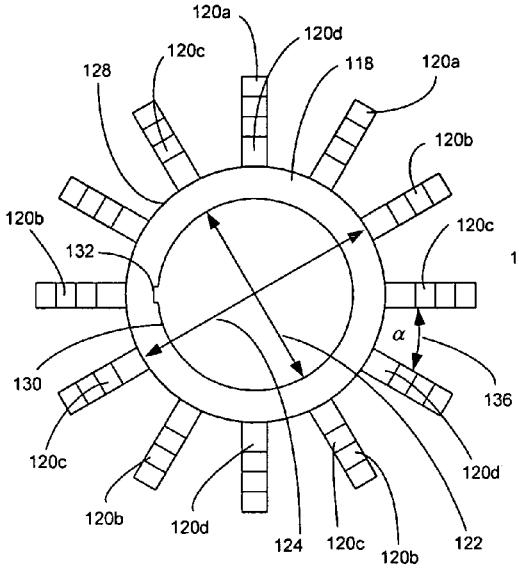
FIG. 8 is a bottom plan view of a third preferred embodiment of a bushing 5 homogenization device.
Figure 9:
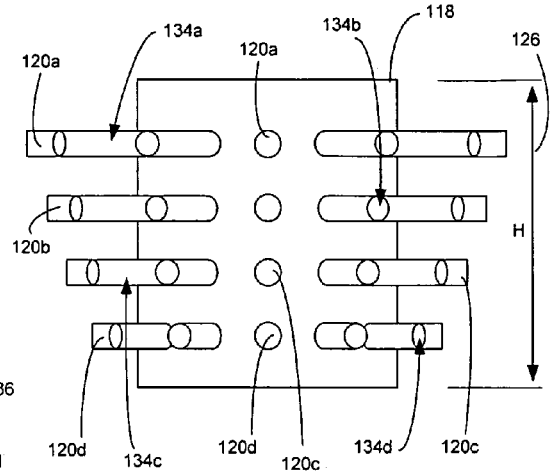
FIG. 9 is a side elevational view of the third preferred embodiment of the bushing homogenization device of FIG. 8.
Figure 10:
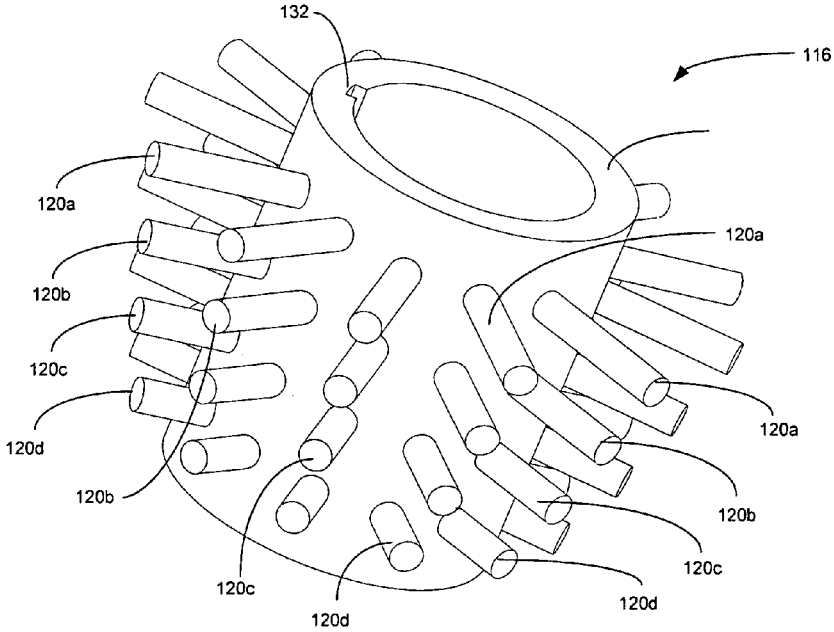
FIG. 10 is a front perspective view of the third preferred embodiment of the bushing homogenization device of FIGS. 8 and 9.

Turning now to FIGS. 8-10, shown therein are bottom, side and front perspective views, respectively, of a third preferred embodiment of the well fluid homogenization device 116. In the third preferred embodiment, the well fluid homogenization device 116 includes the same components present in the first and second preferred embodiments. The well fluid homogenization device 116 of the third preferred embodiment includes a plurality of posts 120 organized within rings 134*a*, 134*b*, 134*c* and 134*d* (collectively or generically referred to as "rings 134") about a central hub 118.

In the third preferred embodiment of FIGS. 8-10, the posts 120 are preferably configured as solid, cylindrical members that are constructed from a deformation-resistance, hardened metal. Unlike the posts 120 of the first and second preferred embodiments, however, the posts 120 of the third preferred embodiment have different lengths depending upon the ring 134 in which the posts 120 are situated. The length of the posts 120 graduates from a shortest length in posts 120*d* in the bottom ring 134*d* to a longest length in posts 120*a* in top ring 134*a*. Like the first preferred embodiment, the rings 134 in the third preferred embodiment each include twelve posts 120 that are separated by a common separation angle (α) 136 of approximately 30°. Additionally, adjacent rings 134 are radially aligned around the circumference of the central hub 118.

Figure 11:
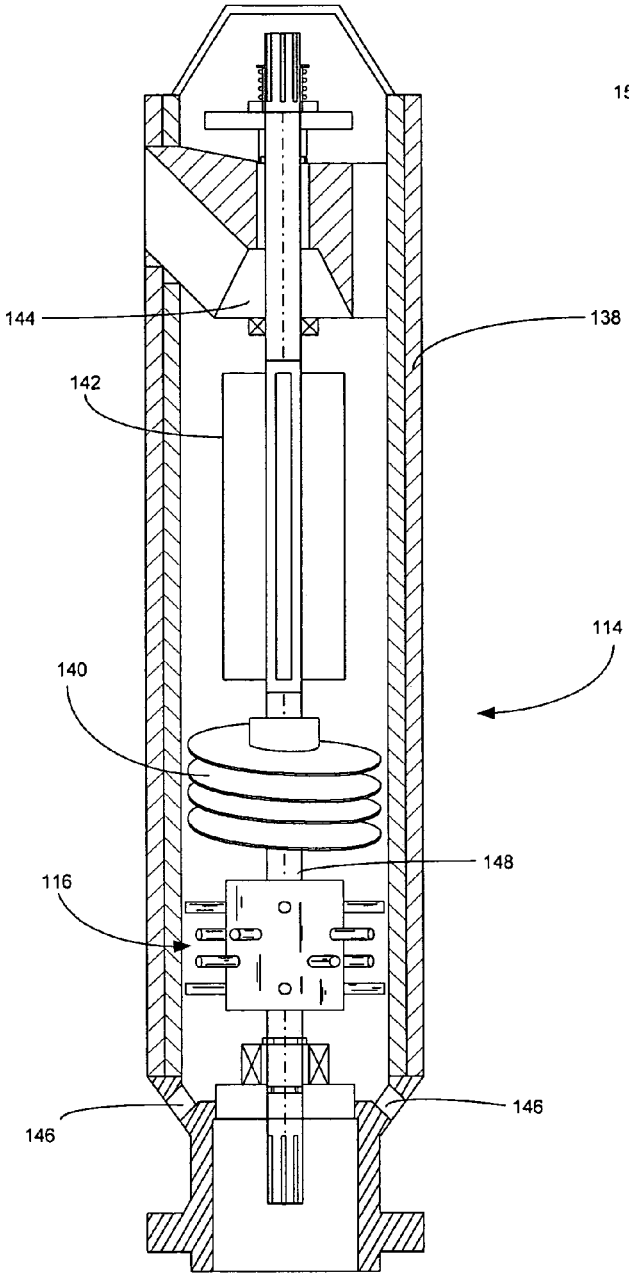
FIG. 11 is a partial cross-sectional view of a gas separator assembly constructed in accordance with a preferred embodiment of the present invention.
Figure 12:
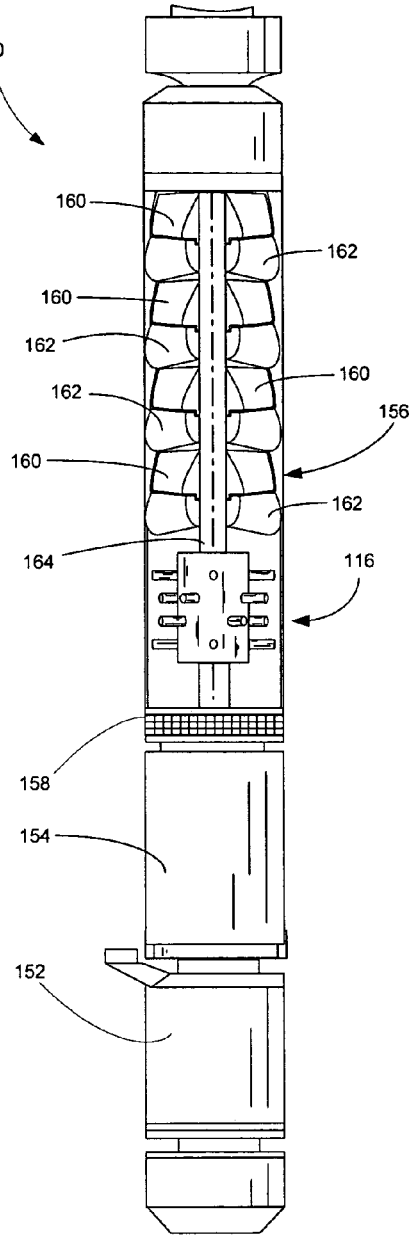
FIG. 12 is a partial cross-sectional view of a pumping system constructed in accordance with an alternate embodiment of the present invention.

Turning now to FIGS. 11 and 12, exemplar uses of the well fluid homogenization device 116 will be discussed with reference to a gas separator and a pump assembly, respectively. FIG. 11 shows a partial cross-sectional view of the gas separator 114. The gas separator 114 preferably includes a housing 138, a lift generator 140, a gas separation component, such as agitator assembly 142, a crossover 144, inlet ports 146 and a drive shaft 148. The housing 138 and crossover 144 are shown in cross-section to better illustrate the internal components.

In the presently preferred embodiment, the lift generator 140 is a configured as a positive-displacement, screw-type pump that moves wellbore fluids from the inlet ports 146 to the agitator assembly 142. The lift generator 140 is connected to the drive shaft 148 and provided mechanical energy from the motor 110. The crossover 144 is preferably configured to gather and remove gas from the gas separator 114 while directing liquid to the downstream pump assembly 108.

The well fluid homogenization device 116 is preferably situated upstream from the lift generator 140 in a position adjacent the inlet ports 146. The well fluid homogenization device 116 is connected to the drive shaft 148 such that the well fluid homogenization device 116 rotates with the drive shaft 148. Although the second preferred embodiment of the well fluid homogenization device 116 is shown in FIG. 11, it will be understood that other embodiments could be alternatively be used. Additionally, while a single well fluid homogenization device 116 is shown in FIG. 11, it will be appreciated that two or more well fluid homogenization devices 116 could also be used.

During use, well fluid is drawn into the gas separator 114 through the inlet ports 146. In many cases, gas pockets and large solid particles are entrained in the well fluid as it enters the gas separator 114. As the well fluid enters the gas separator 114, it passes through the rotating well fluid homogenization device 116. As the well fluid homogenization device 116 rotates, the plurality of posts 120 mixes, blends or "homogenizes" the well fluid by separating large gas pockets into smaller, more manageable bubbles. The mechanical homogenization improves the efficiency of the gas separation process and the overall performance of the pumping system 100. At the same time, large solid particles are pulverized into smaller particles that are more safely handled by downstream equipment.

Turning now to FIG. 12, shown therein is an alternate embodiment of the pumping system 100. Unlike, the pumping system 100 depicted in FIG. 1, the alternate pumping system 150 does not include a gas separator. The pumping system 150 includes a motor 152, a seal assembly 154 and a pump assembly 156. The pump assembly 156 includes an intake 158 adjacent the seal section 154, a plurality of impellers 160 and diffusers 162 and a drive shaft 164. Each pair of impellers 160 and diffusers 162 is referred to as a "turbomachinery stage" (not separately designated). The pump assembly 156 functions by imparting kinetic energy to the well fluid with the rotating impellers 160 and converting a portion of the kinetic energy to pressure head with the static diffusers 162. While efficient, this type of turbomachinery is susceptible to cavitation and damage from contact with large solid particles.

To improve the robustness of the pumping system 150, the pump assembly preferably includes a well fluid homogenization device 116 adjacent the intake 158 in a position upstream from the turbomachinery stages. The well fluid homogenization device 116 is configured for rotation with the drive shaft 164. As well fluid is drawn into the pump assembly 156, the posts 120 of the well fluid homogenization device 116 homogenize the well fluid. Pockets of gas and large particles are broken down into smaller bubbles and particles that can be safely and efficiently processed by the impellers 160 and diffusers 162. It will be understood that, in certain applications, it will be desirable to employ a number of well fluid homogenization devices 116 within the pump assembly 150. It will also be understood that, in other applications, it will be desirable to place a well fluid homogenization device 116 in both the gas separator 114 and the pump assembly 108 of the pumping system 100 of FIG. 1.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A gas separator for use in a downhole pumping system, the gas separator comprising:

an inlet port;

a well fluid homogenization device, comprising:

a central hub; and a plurality of posts extending from the central hub;

a rotatable drive shaft;

a gas separation component; and wherein the well fluid homogenization device is connected to the rotatable drive shaft between the inlet port and the gas separation component.

2. The gas separator of claim 1, wherein the central hub has an inner surface, an outer surface and a height; and wherein the inner radius is sized to accept the rotatable drive shaft.

3. The gas separator of claim 2, wherein the plurality of posts are configured as a plurality of rings disposed at selected positions along the height of the central hub, wherein each of the plurality of posts within a particular ring are connected to the central hub at a common height.

4. A pump assembly for use in a submersible pumping system, the pump assembly comprising:

an inlet port;

a well fluid homogenization device, comprising:

a central hub; and a plurality of posts extending from the central hub;

a rotatable drive shaft; a plurality of turbomachinery stages; and wherein the well fluid homogenization device is connected to the rotatable drive shaft between the inlet port and the plurality of turbomachinery stages.

5. The pump assembly of claim 4, wherein the central hub has an inner surface, an outer surface and a height; and wherein the inner radius is sized to accept the rotatable drive shaft.

6. The pump assembly of claim 5, wherein the plurality of posts are configured as a plurality of rings disposed at selected positions along the height of the central hub, wherein each of the plurality of posts within a particular ring are connected to the central hub at a common height.

* * * * *